United States Patent [19]

Parker et al.

[11] Patent Number: 4,898,687

[45] Date of Patent: Feb. 6, 1990

[54] CORROSION INHIBITOR

[75] Inventors: David C. Parker, Macclesfield; Brian G. Clubley, Wilmslow, both of England

[73] Assignee: Ciba-Geigy Corporation, Ardsley, N.Y.

[21] Appl. No.: 269,085

[22] Filed: Nov. 9, 1988

[30] Foreign Application Priority Data

Nov. 21, 1987 [GB] United Kingdom ..... 8727323

[51] Int. Cl.[4] ..... C09K 15/06

[52] U.S. Cl. ..... 252/389.61; 252/389.62; 252/396; 422/17

[58] Field of Search ..... 252/396, 389.61, 389.62; 549/296; 422/17

[56] References Cited

U.S. PATENT DOCUMENTS 4,003,842 1/1977 Suen et al. ..... 252/387 X

*Primary Examiner*—Howard J. Locker
*Assistant Examiner*—Valerie D. Fee
*Attorney, Agent, or Firm*—Stephen V. O'Brien

[57] ABSTRACT

A composition, in contact with a corrodable metal surface, which composition comprises:

(A) an aqueous-based or oil-based system; and (B) as inhibitor for protecting the metal surface against corrosion, a mixture comprising at least one compound of formula I and at least one compound of formula II:

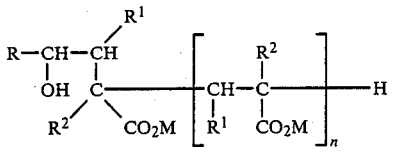

I $R^3[O(CH_2)_m]_pO(CH_2)_{m-1}CO_2M$ II wherein R is a monoalkylglycol ether of formula II $R_3[O(CH_2)_m]_pO(CH_2)_{m-1}-$ III $R^1$ is H, $CO_2M$ or $C_1$–$C_4$ straight or branched chain alkyl residue;

$R^2$ is H, $C_1$–$C_4$ straight or branched chain alkyl residue $-CH_2CO_2M$ or $-CH_2CH_2CO_2M$;

$R^3$ is $C_4$–$C_{20}$ straight or branched chain alkyl residue, $C_6$–$C_{10}$ aryl residue (optionally substituted by $C_1$–$C_{15}$alkyl residues), $C_5$–$C_{12}$cycloalkyl residue, or a $C_7$–$C_{12}$aralkyl group optionally substituted by $C_1$–$C_{15}$alkyl residues;

n is a number from 0 to 20 m is a number from 2 to 4 p is a number from 0 to 20; and

M is a metal ion, H or an optionally substituted ammonium ion.

19 Claims, No Drawings

CORROSION INHIBITOR

The present invention relates to new corrosion inhibitors and their use for protecting metal surfaces against corrosion.

Many compounds or formulations are known to inhibit the corrosion of ferrous metals in contact with aqueous or partially aqueous systems. Traditionally, such corrosion inhibitors contain metals such as chromium or zinc, phosphorus in the form of phosphate, polyphosphate or phosphonate, or sodium nitrite. Most of these known corrosion inhibitors are now believed to have an adverse effect on the environment when they are discharged into water systems. The known corrosion inhibitors can cause environmental damage due to their toxicity or to their tendency to promote biological growth.

Many carboxylic acid derivatives have been examined as alternative corrosion inhibitors. Generally however, high additive levels are required if carboxylic acid derivatives are to provide acceptable corrosion-inhibiting performance. Polymeric carboxylic acids have also been described as corrosion inhibitors but again, high levels of additive are normally required. In U.S. Pat. No. 4003842, carboxylated glycol ethers are described as corrosion and scale inhibitors in aqueous systems.

Surprisingly, we have now found that mixtures of (i) certain hydroxycarboxylic acid derivatves with (ii) certain carboxlyated glycol ethers, provide excellent corrosion inhibitor combinations which are particularly effective for inhibiting corrosion of ferrous metals at low addition levels.

The present invention therefore provides a composition, in contact with a corrodable metal surface, preferably a ferrous metal surface, which composition comprises (A) an aqueous- or oil-based system and (B) as inhibitor for protecting the metal surface against corrosion, a mixture comprising at least one compound of formula I and at least one compound of formula II:

I

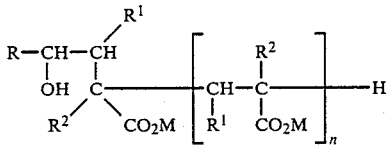

$$R^3[O(CH_2)_m]_pO(CH_2)_{m-1}CO_2M, \qquad \text{II}$$

wherein

R is a monoalkylglycol ether group of formula III $$R^3[O(CH_2)_m]_pO(CH_2)_{m-1}- \qquad \text{III}$$

$R^1$ is H, $CO_2M$ or $C_1$–$C_4$ straight or branched chain alkyl residue, $R^2$ is H, a $C_1$–$C_4$ straight or branched chain alkyl residue, $CH_2CO_2M$ or $CH_2CH_2CO_2M$, $R^3$ is $C_4$–$C_{20}$ straight or branched chain alkyl residue, a $C_6$–$C_{10}$aryl residue or a $C_6$–$C_{10}$aryl residue substituted by $C_1$–$C_5$alkyl residues, a $C_5$–$C_{12}$cycloalkyl group, a $C_7$–$C_{12}$aralkyl group or a $C_7$–$C_{12}$aralkyl group substituted by $C_1$–$C_{15}$alkyl residues, n is 0–20;

m is 2–4;

p is 0–20 and

M is a metal ion, hydrogen, an ammonium ion or a substituted ammonium ion.

M is preferably hydrogen, sodium, potassium or Ca/2. In mixtures of compounds of formula I and II, $R^1$, $R^2$ and $R^3$ may be single residues or mixtures of such residues.

$R^1$ is preferably H or $CO_2M$, wherein M has the same meaning as above.

$R^2$ is preferably H.

$R^3$ is preferably a $C_8$–$C_{20}$ straight or branched chain alkyl residue.

The values of n, m and p can be a mixture of the said values.

n is preferably 0–10 or a mixture of the said values. Preferred, m is 2 or 3 or a mixture of the said values.

p is preferably 0–10, most preferably 0–6, or a mixture of the said values.

When M is H, it will be obvious to those skilled in the art that the compound of formula I may be in the form of its lactone of formula IA:

IA

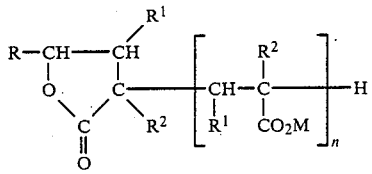

in which R, $R^1$, $R^2$, M and n have their previous significance.

The ratio of compounds I and II in the mixture (B) present in the composition of this invention can be in the range of from 100:1 to 0.01:1, preferably in the range of from 10:1 to 0.1:1, most preferably in the range of from 1:1 to 0.1:1. The ratio is given by parts by weight.

The components of the mixture (B) can be made by mixing together, in the appropriate proportion, a compound or compounds of formula I with a compound or compounds of formula II, or preferably by directly producing a mixture of the appropriate composition by means of a chemical process.

In the case of the preferred mixtures made directly via a chemical process $R^3$, m, p and M have the same values in both components I and II.

The preferred mixtures of I and II are conveniently made by the following process.

An unsaturated compound of formula IV

IV

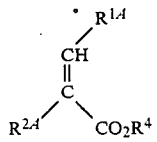

wherein $R^{1A}$ has the same meaning as $R^1$ or is $-CO_2R^4$, $R^{2A}$ has the same significance as $R^2$ or is $-CH_2CO_2R^4$ or $-CH_2CH_2CO_2R^4$ and $R^4$ is a $C_1$–$C_4$alkyl residue; or an unsaturated compound of formula IV in the form of the corresponding anhydride of formula IV A:

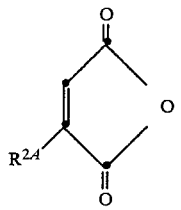

IVA in which $R^{2,4}$ has its previous significance together with an appropriate radical source (e.g. di-tert-butyl peroxide), is added to an alcohol of formula V $$R^3[O(CH_2)_m]_pO(CH_2)_mOH \qquad V$$

wherein $R^3$, m and p have their previous significance, at a temperature sufficient to cause reaction to occur.

The reagents are reacted in the necessary proportions in order to produce compounds of formula I or their lactones of formula IA and preferably also to leave an excess of unreacted alcohol V.

This resulting mixture may then be oxidised by an appropriate method, preferably catalytically, using e.g. oxygen gas in the presence of a metal catalyst, or using sodium hypochlorite in the presence of a free radical, halide salt and phase transfer catalyst. This oxidation stage converts the excess of alcohol V into the acid II. The mixture is preferably saponified by reacting it with an appropriate reagent, for example aqueous sodium hydroxide. This saponification is performed before, at the same time as, or after the oxidation reaction, depending on the oxidation method chosen.

By varying the relative amounts of the initial reagents (IV, V and radical sources) and conditions the ratio of I:II in the product composition can be varied.

Examples of $R_3$ as $C_4$–$C_{20}$alkyl in compounds I and II, are butyl, pentyl, hexyl, heptyl, octyl, nonyl, decyl, undecyl, dodecyl, tridecyl, tetradecyl, pentadecyl, hexadecyl, heptadecyl, octadecyl, nonadecyl and eicosyl. These may be straight or branched chain, for example tridecyl could be n-tridecyl or for example tetramethylnonyl.

Specific but non limiting examples of $R_3$, as $C_5$–$C_{12}$cycloalkyl are cyclopentyl, cyclohexyl, cycloheptyl and cyclododecyl. $C_6$–$C_{10}$aryl groups $R_3$ optionally substituted by $C_1$–$C_{15}$alkyl groups include, for example phenyl, naphthyl, tolyl, xylyl, dodecaphenyl and octylnaphthyl groups.

$C_7$–$C_{12}$aralkyl group $R^3$ include benzyl, 3-phenylpropyl and 2-phenylethyl groups.

When $R^1$, $R^2$ and $R^4$ represent $C_1$–$C_4$alkyl residues, examples are methyl, ethyl, propyl and butyl groups.

Examples of metal ions M are, for instance alkali metal ions such as sodium and potassium, or the equivalents of alkaline earth metal ions such as Ca/2. Ammonioum ions M are, e.g. those of formula

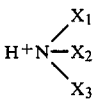

wherein $X_1$, $X_2$ and $X_3$ are independently H or alkyl with 1 to 21 C-atoms, optionally substituted by —OH.

Examples are for instance, ammonium, bis(2-hydroxyethyl)ammonium, tris(2-hydroxyethyl)ammonium and dodecylammonium.

Examples of $R_3$, p and m in alcohols of formula V include those in which the respective substituents are as follows:

| $R^3$ | p | m |
|---|---|---|
| $C_4H_9$— | 0 | 2 |
| $C_4H_9$— | 1 | 2 |
| $C_4H_9$— | 0 | 3 |
| $C_4H_9$— | 1 | 3 |
| $C_7H_{15}$— | 1 | 2 |
| | 2 | 2 |
| | 3 | 2 |
| | 4 | 2 |
| $C_7H_{15}$— | 0 | 3 |
| | 1 | 3 |
| | 2 | 3 |
| | 3 | 3 |
| | 4 | 3 |
| $C_9H_{19}$— | 0 | 2 |
| | 1 | 2 |
| | 2 | 2 |
| | 3 | 2 |
| | 4 | 2 |
| $C_9H_{19}$— | 1 | 3 |
| | 2 | 3 |
| $C_{10}H_{21}$— | 0 | 2 |
| | 2 | 2 |
| | 4 | 2 |
| | 6 | 2 |
| $C_{10}H_{21}$— | 0 | 2 |
| | 2 | 2 |
| | 4 | 2 |
| | 6 | 2 |
| $C_{10}H_{21}$— | 1 | 3 |
| | 3 | 3 |
| | 5 | 3 |
| $C_{11}H_{23}$— | 0 | 2 |
| | 2 | 2 |
| | 4 | 2 |
| | 6 | 2 |
| $C_{11}H_{23}$— | 1 | 3 |
| | 2 | 2 |
| | 4 | 2 |
| | 6 | 2 |
| $C_{12}H_{25}$– | 0 | 2 |
| | 2 | 2 |
| | 4 | 2 |
| | 6 | 2 |
| $C_{12}H_{25}$— | 1 | 3 |
| | 3 | 3 |
| | 5 | 3 |
| $C_{13}H_{27}$— | 0 | 2 |
| | 2 | 2 |
| | 4 | 2 |
| | 6 | 2 |
| $C_{13}H_{27}$— | 1 | 3 |
| | 3 | 3 |
| | 5 | 3 |
| $C_{16}H_{33}$— | 0 | 2 |
| | 2 | 2 |
| | 4 | 2 |
| | 6 | 2 |
| $C_{16}H_{33}$— | 1 | 3 |
| | 3 | 3 |
| | 5 | 3 |
| $C_{20}H_{41}$— | 0 | 2 |
| | 2 | 2 |
| | 4 | 2 |
| | 6 | 2 |
| | 8 | 2 |
| $C_{20}H_{41}$— | 1 | 3 |
| | 3 | 3 |
| | 5 | 3 |
| | 7 | 3 |
| | 9 | 4. |

Specific but non limiting examples of unsaturated compounds IV include acrylic acid, methylacrylate, ethyl acrylate, maleic anhydride, maleic acid, monomethyl maleate, dimethylmaleate, monoethyl maleate, diethyl maleate, itaconic acid, monomethyl itaconate and dimethyl itaconate.

In compounds of formula I the range of values for n can be varied by varying the stoichiometry used in the reaction between alcohol V and the unsaturated compound of formula IV. In this reaction alternatives to di-tert-butyl peroxide are for example u.v. light and $\gamma$-irradiation.

Any amount of component (B) (which is a mixture comprising compound(s) of formula I and II) which is effectivwe as a corrosion inhibitor in the composition according to the invention can be used, but such amount preferably ranges from 0.0001 to 5% by weight, and most preferably from 0.01 to 5% by weight, based on the total weight of the aqueous- or oil-based system.

The present invention also includes a method of protecting a metal surface against corrosion, which comprises the use of a composition as mentioned above. The use of a composition as mentioned above for protecting a metal surface against corrosion is a part of the present invention.

The substrate base for the compositions of the present invention is either (i) an aqueous-based system or (ii) an oil-based system. The substrate base is preferably an aqueous-based system.

Examples of systems which may provide the base for the compositions according to the present invention include functional fluids such as oils for technical use, lubricants e.g. those having a mineral oil, poly-alpha olefin or synthetic carboxylic acid ester base or mixtures thereof; hydraulic fluids e.g. those based on mineral oils, phosphate esters, aqueous polyglycol/polyglycol ether mixtures or glycol systems; oil-in-water or water-in-oil systems; metal-working fluids having, as their base, mineral oil or aqueous systems; water- or aqueous glycol- or ethylene or propylene glycol/methanol based engine coolant systems; transformer- or switch oils; as well as aqueous systems e.g. industrial cooling water; aqueous air-conditioning systems; steam-generating systems; sea-water evaporator systems; hydrostatic cookers; and aqueous closed circuit heating or refrigerant systems.

When a functional fluid system is a synthetic lubricant, examples thereof include lubricants based on a diester of a dibasic acid and a monohydric alcohol, for instance dioctyl sebacate or dinonyladipate; on a triester of trimethylolpropane and a monobasic acid or mixture of such acids, for instance trimethylol propane tripelargonate, trimethylolpropane tricaprylate or mixtures thereof; on a tetraester of pentaerythritol and a monobasic acid or mixture of such acids, for instance pentaerythritol tetracaprylate; or on complex esters derived from monobasic acids, dibasic acids and polyhydric alcohols, for instance a complex ester derived from trimethylol propane, caprylic acid and sebacic acid; or of mixtures thereof.

Other lubricants are those known to the art-skilled and described e.g. in Schewe-Kobek, "Das Schmiermittel-Taschenbuch" (Huethig Verlag, Heidelberg, 1974) and D. Klamann, "Schmierstoffe und verwandte Produkte", (Verlag Chemie, Weinheim, 1982). Especially suitable, apart from the preferred mineral oils are e.g. phosphates, glycols, polyglycols, polyalkylene glycols and poly-alpha olefins.

In order to improve various applicational properties, a functional fluid composition of the invention may also contain other additives such as, for oil-based systems, one or more of antioxidants, metal deactivators, further corrosion or rust inhibitors, viscosity-index improvers, pour-point depressants, dispersants/surfactants or anti-wear additives; and for aqueous-based systems, one or more of antioxidants, other corrosion- and rust inhibitors, metal deactivators, extreme pressure- or anti-wear additives, complexing agents, precipitation inhibitors, biocides, buffering agents and anti-foams.

For oil-based systems, examples of other additives are:

Examples of phenolic antioxidants

1. Alkylated Monophenols
2,6-Di-tert.-butylphenol
2-tert.-butyl-4,6-dimethylphenol
2,6-Di-tert.-butyl-4-ethylphenol
2,6-Di-tert.-butyl-4-n-butylphenol
2,6-Di-tert.-butyl-4-i-butylphenol
2,6-Di-cyclopentyl-4-methylphenol
2-($\beta$-Methylcyclohexyl)-4,6-dimethylphenol
2,6-Di-octadecyl-4-methylphenol
2,4,6-Tri-cyclohexylphenol
2,6-Di-tert.-butyl-4-methoxymethylphenol.
2. Alkylated Hydroquinones
2,6-Di-tert.-butyl-4-methoxyphenol
2,5-Di-tert.-butyl-hydroquinone
2,5-Di-tert.-amyl-hydroquinone
2,6-diphenyl-4-octadecyloxyphenol.
3. Hydroxylated Thiodiphenylethers
2,2'-Thio-bis-(6-tert.butyl-4-methylphenol)
2,2'-Thio-bis-(4-octylphenol)
4,4'-Thio-bis-(6-tert.butyl-3-methylphenol)
4,4'-Thio-bis-(6-tert.butyl-2-methylphenol).
4. Alkylidene-Bisphenols
2,2'-Methylene-bis-(6-tert.-butyl-4-methylphenol)
2,2'-Methylene-bis-(6-tert.-butyl-4-ethylphenol)
2,2'-Methylene-bis-(4-methyl-6-($\alpha$-methylcyclohexyl)-phenol)
2,2'-Methylene-bis-(4-methyl-6-cyclohexylphenol)
2,2'-Methylene-bis-(6-nonyl-4-methylphenol)
2,2'-Methylene-bis-(4,6di-tert.-butylphenol)
2,2'-Ethylidene-bis-(4,6-di-tert.-butylphenol)
2,2'-Ethylidene-bis-(6-tert.-butyl-4-isobutylphenol)
2,2'-Methylene-bis-(6-($\alpha$-methylbenzyl-4-nonylphenol)
2,2'-Methylene-bis-(6-($\alpha,\alpha$-dimethylbenzyl)-4-nonylphenol)
4,4'-Methylene-bis-(6-tert.-butyl-2-methylphenol)
1,1'-Bis-(5-tert.-butyl-4-hydroxy-2-methylphenol)-butane
2,6'-Di-(3-tert.butyl-5-methyl-2-hydroxybenzyl)-4-methylphenol
1,1,3-Tris-(5-tert.butyl-4-hydroxy-2-methylphenyl)-3-n-dodecyl-mercaptobutane
Ethyleneglycol-bis-[3,3-bis-(3'-tert.-butyl-4'-hydroxyphenyl)-butyrate]
Di-(3-tert.-butyl-4-hydroxy-5-methylphenyl)-dicyclopentadiene
Di-[3'-tert.-butyl-2'-hydroxy-5'-methyl-benzyl)-6-tert.-butyl-4-methylphenyl]-terephthalate.
5. Benzyl Compounds
1,3,5-Tri-(3,5-di-tert.-butyl-4-hydroxybenzyl)-2,4,6-trimethylbenzene
Di-(3,5-di-tert.-butyl-4-hydroxybenzyl)-sulfide Bis-(4-tert.-butyl-3-hydroxy-2,6-dimethylbenzyl)dithiolterephthalate
1,3,5-Tris-(3,5-di-tert.-butyl-4-hydroxybenzyl)-isocyanurate
1,3,5-Tris-(4-tert.-butyl-3-hydroxy-2,6-dimethylbenzyl)-isocyanurate
3,5-Di-tert.-butyl-4-hydroxybenzyl-phosphonic acid-dioctadecyl-ester
3,5-Di-tert.-butyl-4-hydroxybenzyl-phosphonic acid-mónoethylester calcium-salt.

6. Acylaminophenols
4-Hydroxy-lauric acid anilide
4-Hydroxy-stearic acid anilide
2,4-Bis-octylmercapto-6-(3,5-di-tert.-butyl-4-hydroxyanilino)-s-triazine
N-(3,5-di-tert.-butyl-4-hydroxyphenyl)-carbamic acid octyl ester.

7. Esters of β-(3,5-Di-tert.-butyl-4-hydroxyphenol)-propionic acid with mono- or polyhydric alcohols e.g. with:

| | |
|---|---|
| Methanol | Diethyleneglycol |
| Octadecanol | Triethyleneglycol |
| 1,6-Hexandiol | Pentaerythritol |
| Neopentylglycol | Tris-hydroxyethyl-isocyanurate |
| Thiodiethyleneglycol | Di-hydroxyethyl-oxalic acid diamide. |

8. Esters of β-(5-tert.-butyl-4-hydroxy-3-methyl-phenyl)-propionic acid with mono- or polyhydric alcohols e.g. with:

| | |
|---|---|
| Methanol | Diethyleneglycol |
| Octadecanol | Triethyleneglycol |
| 1,6-Hexandiol | Pentaerythritol |
| Neopentylglycol | Tris-hydroxyethyl-isocyanurate |
| Thiodiethyleneglycol | Di-hydroxyethyl-oxalic acid diamide. |

9. Amides of β-(3,5-Di-tert.-butyl-4-hydroxyphenyl)-propionic acid e.g.
N,N'-Di-(3,5-di-tert.-butyl-4-hydroxyphenylpropionyl)hexamethylene-diamine
N,N'-Di-(3,5-di-tert.-butyl-4-hydroxyphenylpropionyl)-trimethylene-diamine
N,N'-Di-(3,5-di-tert.-butyl-4-hydroxyphenylpropionyl)-hydrazine.

Examples of amine antioxidants:

N,N'-Di-isopropyl-p-phenylenediamine
N,N'-Di-sec.-butyl-p-phenylenediamine
N,N'-Bis(1,4-dimethyl-pentyl)-p-phenylenediamine
N,N'-Bis(1-ethyl-3-methyl-pentyl)-p-phenylenediamine
N,N'-Bis(1-methyl-heptyl)-p-phenylenediamine
N,N'-Bis(1-methyl-heptyl)-p-phenylenediamine
N,N'-Dicyclohexyl-p-phenylenediamine
N,N'-Diphenyl-p-phenylenediamine
N,N'-Di-(naphthyl-2-)-p-phenylenediamine
N-Isopropyl-N'-phenyl-p-phenylenediamine
N-(1,3-dimethyl-butyl)-N'-phenyl-p-phenylenediamine
N-(1-Methyl-heptyl)-N'-phenyl-p-phenylenediamine
N-Cyclohexyl-N'-phenyl-p-phenylenediamine
4-(p-Toluene-sulfonamido)-diphenylamine
N,N'-dimethyl-N,N'-di-sec.-butyl-p-phenylenediamine
Diphenylamine
4-Isopropoxy-diphenylamine
N-Phenyl-1-naphthylamine
N-Phenyl-2-naphthylamine
octylated Diphenylamine
octylated N-phenyl-α or β-naphthylamine
4-n-Butylaminophenol
4-Butyrylamino-phenol
4-Nonanoylamino-phenol
4-Isodecanoylamino-phenol
4-Octadecanoylamino-phenol
Di-(4-methoxy-phenyl)-amine
2,6-Di-tert.-butyl-4-dimethylamino-methyl-phenol
2,4'-diamino-diphenylmethane
4,4'-Diamino-diphenylmethane
N,N,N',N'-Tetramethyl-4,4'-diamino-diphenylmethane
1,2-Di-(phenylamino)-ethane
1,2-Di-[(2-methyl-phenyl)-amino]-ethane
1,3-Di-(phenylamino)-propane (o-tolyl)-biguanide
Di-[4-(1',3'-dimethyl-butyl)-phenyl]amine.

Examples of metal deactivators are: for copper e.g.

Benzotriazole, tolutriazole and derivatives thereof, tetrahydrobenzotraizole, 2-mercaptobenzthiazole, 2,5-dimercaptothiadiazole, salicylidene-propylenediamine and salts of salicylaminoguanidine.

Examples of corrosion or rust inhibitors are:

(a) Organic acids, their esters, metal salts and anhydrides e.g.
N-oleoyl-sarcosine, sorbitan-mono-oleate, lead-naphthenate, dodecenylsuccinic acid (and its partial esters and amides), 4-nonyl-phenoxy-acetic acid.
(b) Nitrogen-containing compounds e.g.
I. Primary, secondary or tertiary aliphatic or cycloaliphatic amines and amine-salts of organic and inorganic acids e.g. oil-soluble alkylammonium carboxylates.
II. Heterocyclic compounds e.g. substituted imidazolines and oxalines.
(c) Phosphorus-containing compounds e.g.
Amine salts of phosphonic acid partial esters, zinc dialkyldithio phosphates.
(d) Sulfur-containing compounds e.g.
Barium-dinonylnaphthalene-n-sulfonates, calcium petroleum sulfonates.

Examples of viscosity-index improvers are e.g.

Polymethacrylates, vinylpyrrolidone/methacrylate-copolymers, polybutenes, olefin-copolymers styrene/acrylate-copolymers.

Examples of pour-point depressants are e.g.

Polymethacrylates, or alkylated naphthalene derivatives.

Examples of dispersants/surfactants are e.g.

Polybutenylsuccinic acid-amides, polybutenylphosphonic acid derivatives, basic magnesium-, calcium-, and bariumsulfonates and -phenolates.

Examples of anti-wear/extreme-pressure additives are e.g.

Sulfur- and/or phosphorus- and/or halogen-containing compounds e.g.
sulfurised vegetable oils, zinc dialkyldithiophosphates, tritolylphosphate, chlorinated paraffins, alkyl- and aryldisulfides.

In the treatment of substrates which are completely aqueous, such as cooling water systems, air-conditioning systems, steam-generating systems, sea-water evaporator systems, hydrostatic cookers, and closed circuit heating or refrigerant systems, further additives may be used such as, corrosion inhibitors, for example, water soluble zinc salts; phosphates; polyphosphates; phosphonic acids and their salts, for example, hydroxyethyldiphosphonic acid (HEDP), nitrilotris methylene phosphonic acid and methylamino dimethylene phosphonocarboxylic acids and their salts, for example, those described in German Offenlegungsschrift 2632774, hydroxyphosphonacetic acid, 2-phosphonobutane-1,2,4-tricarboxylic acid and those disclosed in GB 1572406; nitrates, for example sodium nitrate; nitrites e.g. sodium nitrite; molybdates e.g. sodium molybdate; tungstates; silicates e.g. sodium silicate; benzotriazole, bis-benzotriazole or copper deactivating benzotriazole or tolutriazole derivatives or their Mannich base derivatives; mercaptobenzothiazole; N-acyl sarcosines; N-acylimino diacetic acids; ethanolamines; fatty amines; and polycarboxylic acids, for example, polymaleic acid and polyacrylic acid, as well as their respective alkali metal salts, copolymers of maleic anhydride, e.g. copolymers of maleic anhydride and sulfonated styrene, copolymers of acrylic acid e.g. copolymers of acrylic acid and hydroxyalkylated acrylic acid, and substituted derivatives of polymaleic and polyacrylic acids and their copolymers. Moreover, in such completely aqueous systems, the corrosion inhibitor used according to the invention may be used in conjunction with dispersing and/or threshold agents e.g. polymerised acrylic acid (or its salts), phosphino-polycarboxylic acids (as described and claimed in British Patent 1458235), the cotelomeric compounds described in European Patent Application No. 0150706, hydrolysed polyacrylonitrile, polymerised methacrylic acid and its salts, polyacrylamide and co-polymers thereof from acrylic and methacrylic acids, lignin sulphonic acid and its salts, tannin, naphthalene sulphonic acid/formaldehyde condensation products, starch and its derivatives, cellulose, acrylic acid/lower alkyl hydroxyacrylate copolymers e.g. those described in U.S. Pat. No. 4029577, styrene/-maleic anhydride copolymers and sulfonated styrene homopolymers e.g. those described in U.S. Pat. No. 4374733 and combinations thereof. Specific threshold agents, such as for example, 2-phosphono-butane-1,2,4-tri-carboxylic acid (PBSAM), hydroxyethyldiphosphonic acid (HEDP) hydrolysed polymaleic anhydride and its salts, alkyl phosphonic acid, hydroxyphosphonoacetic acid 1-aminoalkyl-1, 1-diphosphonic acids and their salts, and alkali metal polyphosphates, may also be used.

Particularly interesting additive packages are those comprising mixtures of the invention with one or more of polymaleic acid or polyacrylic acid or their copolymers, and/or hydroxyphosphonoacetic acid and/or HEDP and/or PBSAM and/or other phosphonocarboxylic acids and/or triazoles e.g. tolutriazole.

Precipitating agents such as alkali metal orthophosphates, carbonates; oxygen scavengers such as alkali metal sulphites and hydrazines; sequestering agents such as nitrilotriacetic acid and its salts; anti-foaming agents such as silicones e.g. polydimethylsiloxanes, distearylsebacamides, distearyl adipamide and related products derived from ethylene oxide and/or propylene oxide condensations, in addition to fatty alcohols, such as capryl alcohols and their ethylene oxide condensates; and biocides e.g. amines, quaternary ammonium compounds, chlorophenols, sulphur-containing compounds such as sulphones, methylene bis thiocyanates and carbamates, isothiazolones, brominated propionamides, triazines, phosphonium compounds, chlorine and chlorine-release agents and organometallic compounds such as tributyl tin oxide, may be used.

The functional fluid system may be partly aqueous e.g. an aqueous machining fluid formulation, e.g. a water dilutable cutting or grinding fluid.

The aqueous machining fluid formulations according to the invention may be e.g. metal working formulations. By "metal working" we mean reaming, broaching, drawing, spinning, cutting, grinding, boring, milling, turning, sawing, non-cutting shaping, rolling or quenching. Examples of water-dilutable cutting or grinding fluids into which the corrosions inhibiting compound may be incorporated include:

(a) Aqueous concentrates of one or more corrosion inhibitors, and optionally one or more anti-wear additives which are usually employed as grinding fluids;

(b) Polyglycols containing biocides, corrosion inhibitors and anti-wear additives for cutting operations or grinding;

(c) Semi-synthetic cutting fluids similar to (b) but containing in addition 10 to 25% oil with sufficient emulsifier to render the water diluted product translucent;

(d) An emulsifiable mineral oil concentrate containing, for example, emulsifiers, corrosion inhibitors, extreme pressure/anti-wear additives, biocides, antifoaming agents, coupling agents etc.; they are generally diluted with water to a white opaque emulsion;

(e) A product similar to (d) containing less oil and more emulsifier which on dilutiion gives a translucent emulsion for cutting or grinding operations.

For these partly-aqueous systems in which the functional fluid is an aqueous machining fluid formulation the inhibitor component (B) may be used singly, or in admixture with other additives e.g. known further corrosion inhibitors or extreme-pressure additives. Such extreme-pressure additives are listed above.

Examples of other corrosion inhibitors which may be used in these partly aqueous systems, in addition to the compound of formula I used according to the invention, include the following groups:

(a) Organic acids, their esters or ammonium, amine, alkanolamine and metal salts, for example, benzoic acid, p-tert-butyl benzoic acid, disodium sebacate, triethanolamine laurate, iso-nonanoic acid, triethanolamine salt of p-toluene sulphonamido caproic acid, triethanolamine salt of benzene sulphonamido caproic acid, triethanolamine salts of 5-ketocarboxylic acid derivatives as described in European Patent No. 41927, sodium N-lauroyl sarcosinate or nonyl phenoxy acetic acid;

(b) Nitrogen containing materials such as the following types: fatty acid alkanolamides; imidazolines, for example, 1-hydroxy-ethyl-2-oleylimidazolines; oxazolines; triazoles for example, benzotriazoles; or their Mannich base derivatives; triethanolamines; fatty amines, inorganic salts, for example, sodium nitrate; and the carboxy-triazine compounds described in European Patent No. 46139;

(c) Phosphorus containing materials such as the following types: amine phosphates, phosphonic acids, or inorganic salts, for example, sodium dihydrogen phosphate or zinc phosphate;

(d) Sulphur containing compounds such as the following types: sodium, calcium or barium petroleum sulphonates, or heterocyclics, for example, sodium mercaptobenzothiazole. Nitrogen containing materials, particularly triethanolamine, are preferred.

The following Examples further illustrate the present invention. Parts and percentages are by weight, unless stated otherwise.

EXAMPLE 1

80.4 parts of Dobanol 91-2.5 (A Shell product of $C_9$–$C_{11}$ linear alcohols ethoxylated with an average of 2.5 moles of ethylene oxide per mole of alcohol) is stirred and heated to 150° C. Over 6 hours 14.4 parts of dimethyl maleate containing 2.5 parts of di-tert. butyl peroxide is added dropwise. After completion of the addition the mixture is heated at reflux for a further 3 hours. The volatile by-products are removed by reduced pressure distillation. The residue is then refluxed with 8 parts of sodium hydroxide in 150 ml of water for 14 hours, then cooled and diluted by the addition of 1500 ml of distilled water. 2.5 parts of 5% Pd on charcoal is added and the mixture heated in an oxygen atmosphere. The pH of the mixture is kept constant by addition of 5M sodium hydroxide solution. After the addition of 40 mls of this solution the reaction mixture is cooled and filtered.

The orange/green filtrate is collected, and by evaporation a sample is found to have a solids content of 4.6%.

EXAMPLES 2–4

Corrosion inhibitor activity of the product according to Example 1, and also of the individual compounds (I and II) [these are produced by appropriate modification of the process given in Example 1] is evaluated using the Aerated Solution Bottle Test, using four corrosive waters A, B, C and D. Analyses of these waters are given in Table 1.

TABLE 1

| | A | B | C | D |
|---|---|---|---|---|
| pH | 7.0 | 8.7 | 9.0 | 9.0 |
| Total alkalinity (as ppm $CaCO_3$) | 20 | 150 | 350 | 300 |
| Calcium (as ppm $CaCO_3$) | 50 | 150 | 150 | 300 |
| Chloride (ppm as $Cl^-$) | 20 | 60 | 200 | 200 |
| Sulphate (ppm as $SO_4^{2-}$) | 20 | 50 | 200 | 80 |

2 mild steel coupons, 5 cms×2.5 cms are scrubbed with pumice, immersed for one minute in hydrochloric acid and then rinsed, dried and weighed.

The desired proportion of test compound is dissolved in 200 ml of each corrosive water. Two steel coupons are suspended in the solution, and the whole is stored in a closed bottle in a thermostat bath at 40° C. During the storage period, air is passed into the solution at 500 ml/minute, the passage of the air being screened from the steel coupons; any water losses by evaporation are replaced with distilled water.

After 64 hours, the steel coupons are removed, scrubbed without pumice, immersed for one minute in hydrochloric acid inhibited with 1% by weight of hexamine and then rinsed, dried and reweighed. A certain loss in weight will have occurred. A blank test i.e. immersion of mild steel specimens in the test water in the absence of any potential corrosion inhibitor, is carried out with each series of tests. The corrosion rates are calculated in milligrams of weight loss/square decimeter/day (m.d.d.).

The corrosion rate results obtained for each test compound are shown in Table 2.

TABLE 2

| Example No. | Composition Tested | Additive conc. ppm. | Corrosion rate (mdd) water A | B | C | D |
|---|---|---|---|---|---|---|
| 2 | Mixture produced in Example 1 | 200 | 3 | 3 | 5 | 2 |
| 3 | Compound II[1] of the composition in Example 1 alone | 200 | not tested | 51 | not tested | 56 |
| 4 | Compound I[2] of the composition in Example 1 alone | 200 | 12 | 45 | 51 | 44 |

[1] $C_9/C_{11}$—alkyl—O—$(CH_2CH_2O)_{1.5}$—$CH_2CO_2H$

[2] $C_9/H_{11}$—alkyl-O—$(CH_2CH_2O)_{1.5}$—$CH_2$(OH)—$CH$($CH_2$—$CO_2H$)—$CO_2H$ From these results it can be clearly seen that the corrosion inhibitor composition according to the present invention shows excellent activity as a corrosion inhibitor in all the test waters and, further, this composition is clearly superior to its individual components listed separately.

We claim:

1. A composition, in contact with a corrodable metal surface, which composition comprises:

(A) an aqueous-based or oil-based system; and (B) as inhibitor for protecting the metal surface against corrosion, a mixture comprising at least one compound of formula I and at least one compound of formula II:

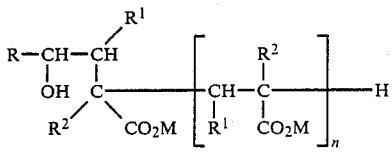

I $R^3[O(CH_2)_m]_pO(CH_2)_{m-1}CO_2M$, II wherein

R is a monoalkylglycol ether group of formula III $R^3[O(CH_2)_m]_pO(CH_2)_{m-1}$— III $R^1$ is H, $CO_2M$ or $C_1$–$C_4$ straight or branched chain alkyl residue;

$R^2$ is H, $C_1$–$C_4$ straight or branched chain alkyl residue, —$CH_2CO_2M$ or —$CH_2CH_2CO_2M$;

$R^3$ is $C_4$–$C_{20}$ straight or branched chain alkyl residue, $C_6$–$C_{10}$aryl residue, $C_6$–$C_{10}$aryl residue substituted by $C_1$–$C_{15}$alkyl residues, $C_5$–$C_{12}$cycloalkyl residue, a $C_7$–$C_{12}$aralkyl group, or a $C_7$–$C_{12}$aralkyl group substituted by $C_1$–$C_{15}$alkyl residues;

n is a number from 0 to 20;

m is a number from 2 to 4;

p is a number from 0 to 20; and

M is a metal ion, hydrogen, an ammonium ion or a substituted ammonium ion.

2. A composition according to claim 1 wherein the corrodable metal surface is a ferrous metal surface.

3. A composition according to claim 1 wherein $R^1$ is H or $CO_2M$.

4. A composition according to claim 1 wherein $R^2$ is H.

5. A composition according to claim 1 wherein $R^3$ is a $C_8$–$C_{20}$ straight or branched chain alkyl residue.

6. A composition according to claim 1 wherein n is a number from 0 to 10.

7. A composition according to claim 1 wherein m is a number from 2 to 3.

8. A composition according to claim 1 wherein p is a number from 0 to 6.

9. A composition according to claim 1 wherein M is hydrogen, sodium, potassium or Ca/2.

10. A composition according to claim 1 wherein the total amount of the mixture of compound(s) of formula I and II ranges from 0.0001 to 5% by weight, based on the total weight of the aqueous- or oil-based system.

11. A composition according to claim 10 wherein the total amount of the mixture of compound(s) of formula I and II ranges from 0.01 to 5% by weight, based on the total weight of the aqueous- or oil-based system.

12. A composition according to claim 1 wherein the ratio of compounds I and II in the mixture (B) is in the range of from 100:1 to 0.01:1.

13. A composition according to claim 12 wherein the ratio of compounds I and II in the mixture (B) is in the range of from 10:1 to 0.1:1.

14. A composition according to claim 13 wherein the ratio of compounds I and II in the mixture (B) is in the range of from 1:1 to 0.1:1.

15. A composition according to claim 1 wherein the system is oil-based and the system also contains one or more antioxidants, metal deactivators, further corrosion or rust inhibitors, viscosity-index improvers, pour-point depressants, dispersants/surfactants or anti-wear additives.

16. A composition according to claim 1, wherein the system is aqueous-based and the system contains one or more of antioxidants, other corrosion and rust inhibitors, metal deactivators, extreme pressure or anti-wear additives, complexing agents, precipitation inhibitors, biocides, buffering agents and anti foams.

17. A composition according to claim 1 wherein the system is completely aqueous and the system also contains one or more further corrosion inhibitors, dispersing and/or threshold agents, precipitating agents, oxygen scavengers, sequestering agents; antifoaming agents; and biocides.

18. A composition according to claim 1 wherein the system is partly aqueous and the system also contains one or more further corrosion inhibitors or extreme-pressure additives.

19. A method of protecting a metal surface against corrosion, which comprises applying a composition according to claim 1 to said metal surface.

* * * * *